US005485888A

United States Patent [19]

England

[11] Patent Number: 5,485,888

[45] **Date of Patent: *Jan. 23, 1996**

[54] SPHERICAL REAMING BIT

[75] Inventor: J. Richard England, Sudbury, Canada

[73] Assignee: R. H. Woods, Ltd., Watford, Canada

[ * ] Notice: The term of this patent shall not extend beyond the expiration date of Pat. No. 08/383,223.

[21] Appl. No.: 383,223

[22] Filed: Feb. 3, 1995

Related U.S. Application Data

[63] Continuation-in-part of Ser. No. 62,174, May 17, 1993, Pat. No. 5,413,183.

[51] Int. Cl.[6] ..... E21B 10/22

[52] U.S. Cl. ..... 175/53; 175/406

[58] Field of Search ..... 175/53, 406; 299/92

[56] References Cited

U.S. PATENT DOCUMENTS

| | | | |
|---|---|---|---|
| 4,241,799 | 12/1980 | Going, III | 175/361 |
| 4,244,433 | 1/1981 | Kellner | 175/344 |
| 4,280,571 | 7/1981 | Fuller | 175/337 |
| 4,399,879 | 8/1983 | Liljekvist | 175/372 |
| 4,484,783 | 11/1984 | Emmerich | 299/86 |
| 4,591,008 | 5/1986 | Oliver | 175/227 |
| 4,610,317 | 9/1986 | England et al. | 175/331 |
| 4,641,718 | 2/1987 | Bengtsson | 175/331 |
| 5,145,016 | 9/1992 | Estes | 175/331 |
| 5,413,183 | 5/1995 | England | 175/53 |

*Primary Examiner*—William P. Neuder
*Attorney, Agent, or Firm*—McFadden, Fincham

[57] ABSTRACT

A reamer bit for reaming in earth formations. In one embodiment, the bit provides a plurality of levels of stems onto which may be disposed semi-spherical reamer cutters. The cutters are arranged such that they are circumscribable within a sphere. The levels of stems may include as few as two stems or several. This arrangement provides for a significantly larger cutting area which, in turn, prevents premature bit wear. As s further advantage, the bit may include several levels with roller cutters having progressively increasing diameter to provide an arrangement which subscribes to a generally triangular formation.

22 Claims, 6 Drawing Sheets

SPHERICAL REAMING BIT

This is a continuation-in-part of U.S. Ser. No. 08/062,174, filed May 17, 1993, now U.S. Pat. No. 5,413,183.

FIELD OF THE INVENTION

The present invention relates to a spherical reaming bit and more particularly, the invention relates to an improved reaming bit for use in reaming.

BACKGROUND OF THE INVENTION

Reaming arrangements have been proposed in the art previously. Generally speaking, reamers provide particular use in enlarging pilot holes previously drilled. The reaming bit is pulled through a drilled pilot hole rather than pushed and accordingly, a substantial amount of friction is received by the reaming faces and particularly at the cutting bits or buttons thereof.

During a reaming procedure when employing conventional reamer bits such as those of a cylindrical geometry, the friction experienced by the reaming face is not regular or uniform at all positions thereover. As a natural consequence, irregular wear occurs on the reaming face with the possibility of having completely "bald" areas on the face, completely devoid of cutting inserts, while other areas are unaffected. A further difficulty with present arrangements is that the same generally wear out to the point of being useless far too quickly.

In addition to the above, the present design of reaming bits in which the individual members of the bit are cropped together, provide a large number of areas between the individual members within which debris may become trapped. The result is that the individual members of the bit jam and subsequently are dragged within the formation. Such conditions eventually destroy the individual members of the bit and eventually the entire bit.

In a related matter, the reaming faces, when the same become worn or the cutting bits dull, etc., require replacement which poses a fairly involved procedure in terms of time. Generally, the bearings of the reaming faces are associated with the interior of the faces themselves. This is inconvenient when exchange or replacement is required. Since the overall reaming arrangement may present no further utility for reasons outlined above, the bearing system associated therewith may be in perfect working order, but must be discarded with the spent arrangement. This clearly has negative ramifications in terms of cost and productivity and is an unnecessary waste.

One of the primary difficulties in this art is the fact that many of the cutter arrangements presently patented are not true rolling arrangements. Due to the lack of this feature, there is at least a portion of the area of the roller cutter which becomes useless and is scuffed and prematurely worn out. This additionally creates problems in terms of the enormous torque forces that are required to operate the tool among other disadvantages.

Typical of the existing prior art in this field is exemplified by U.S. Pat. No. 4,399,879, issued Aug. 23, 1983, to Liljekvist et al. The Liljekvist arrangement provides a boring head in which there is provided a plurality of roll cutters, each rotatably journaled over a bearing system. The rollers in this reference do not have a semi-circular profile or subscribe to a semi-spherical shape, but rather are substantially frustoconical in shape.

Going, in U.S. Pat. No. 4,241,799, issued Dec. 30, 1980, provides a protective cutter mounting for drill bits. In the reference, the cutter is composed of a plurality of cutter assemblies which subscribe to a frustoconical shape. There is no provision for a multiple cutter head assembly where the heads provide a plurality of spherical faces.

In U.S. Pat. No. 4,641,718, issued to Bengtsson, Feb. 10, 1987, the patentee discloses a rotary drill bit comprising a cutter bit having a plurality of cutters within the body. Similar to the above references, the Bengtsson arrangement cannot provide a true rolling rotary drill bit and accordingly, this reference does nothing to solve the problem currently experienced in the drilling and mining art with respect to undue premature wear and limited use out of the bits and related equipment.

Other references which are generally relevant to the art to which the present invention is related includes U.S. Pat. Nos. 5,145,016, 4,591,008, 4,244,433, 4,280,571 and 4,484,783.

SUMMARY OF THE INVENTION

One object of the present invention is to provide an improved reamer bit for use in drilling in earth formations.

A further object of one embodiment of the present invention is to provide a bit for reaming an opening in an earth formation, comprising: at least one stem for connection with drive means; at least three shafts on the stem, each shaft for movably mounting a semi-spherical roller cutter; and a plurality of semi-spherical roller cutters, each shaft including a semi-spherical roller cutter, the roller cutters being arranged on the shafts such that the semi-spherical roller cutters are circumscribable in a sphere.

A significant feature of the above-mentioned embodiment of the invention is that the stem may include a plurality of spaced-apart levels of shafts. Shafts in one level may be either collinear with the shafts in a preceding level or may be non-collinear, depending on the application. In addition, within each level of shafts, the shafts may be in a coplanar relationship or may reside in parallel planes relative to one another.

As a preferred feature, the shaft includes semi-spherical roller cutter bodies and once the cutter bodies are positioned on a respective shaft, the cutter bodies, in a given level, may be circumscribable within a sphere. It has been found that this arrangement significantly reduces bit wear and provides a maximum area for high cutting efficiency torque.

Advantageously, it has been found that where the roller cutter has a generally semi-circular form and has an area, which area can be entirely positioned within a sector of a circle, true rolling can be achieved. If this requirement is not observed, true rolling does not occur and the subsequent scuffing and premature wear readily occurs on the drilling bit and subsequently results in ever increasing amounts of torque required to employ the tool. In previous systems proposed in the prior art, no provision was made for a true rolling cutter body since the cutters could not subscribe to the above limitation. In the present invention, the sector is centered on the center point of the stem. This was previously not observed in the prior art and this feature is one of the many features that is attributed to the success of the present arrangement.

Further still, an attractive feature associated with the present invention is that the roller cutter means are easily removable from the shafts and may accommodate a host of varying diameters of bodies. This is beneficial when quick changes are required at a drilling site.

Conveniently, by employing the shafts as set forth with the present invention, the bearing means are covered by the roller cutter body and further, the bearing arrangement is essentially contained within the body. A simple fastener, for example, a circlip, is employed to mount a dust cover over a bolting arrangement, the latter mounting the roller cutter body to the shaft. This clearly obviates the use of external saddle mounts and other such arrangements which are inherent with the prior art. This clearly avoids the premature wear problem conventionally associated with the prior art and further maintains a relatively smooth semi-circular cross-sectional configuration for the overall spherical reaming bit.

A further object of the present invention is to provide a stem for use in drilling, the stem adapted for connection with drive means, the stem including at least three shafts in fluid communication with the stem, the shafts for releasably and rotatably mounting roller cutter means.

In an advantageous arrangements of one embodiment of the present invention, the stem may be composed of two or more segments in order to form a multiple stem, multiple roller cutter bit. This has the advantage of providing the user with the possibility of increasing the roller cutter diameter progressively along the length of the stem.

The removable cutter bodies may further include individually removable cutting bits releasably engageable within openings in each of the cutter bodies. Typical of bits incorporated in such arrangement comprise Kannenmetal™ picks, picks manufactured by the Sollami Company, and other such bits or picks known to those skilled in the drilling and mining arts.

As an ancillary feature of the invention, a double shaft may be provided. This provision allows the user to easily recover an inoperable unit or one which has become lodged and immobile; this is an attractive feature since, conventionally, reaming units were irretrievable due to the absence of this provision.

As a convenient feature, the stem may include directional valves therein. The use of the valves is convenient when it is desirable to "backflush" a reaming opening which has become clogged with debris during the reaming process.

Typically, many ore deposits of varying degrees of ore concentration have been abandoned due to the cost of replacing bits, reamers and other equipment or due to the extent of drilling to reach a deposit location.

An embodiment of the present invention makes it more feasible to reach such deposits since the cost of the overall procedure is significantly reduced by the incorporation of the inventive features set forth herein.

A further object of the present invention is to provide a reamer bit for reaming in earth formations, the reamer bit comprising: stem means for connecting with a drive source; a plurality of levels of shafts arranged on the stem means, the shafts having means for communicating with a fluid source; a plurality of semi-spherical reamer cutters, each cutter being releasably and rotatably mounted to a shaft, the semi-spherical roller cutters being arranged on the shafts to provide a spherical reamer face.

Further advantages of the present invention include the fact that reaming is possible from any direction; the faces, due to the semi-spherical shape, effectively clear debris away from the faces such that jamming from debris collection is avoided and the fact that the arrangement may be employed in push/pull reaming.

Singly or in combination, the advantages associated with the present invention have a dramatic effect on drilling expenditures on a cost per foot basis and accordingly, the present invention facilitates cost effective access to previously abandoned areas or areas having difficult ground conditions.

Having thus generally described the invention, reference will now be made to the accompanying drawings illustrating preferred embodiments.

BRIEF DESCRIPTION OF THE DRAWINGS

Similar numerals in the drawings denote similar elements.

DETAILED DESCRIPTION OF THE PREFERRED EMBODIMENT

Figure 1:
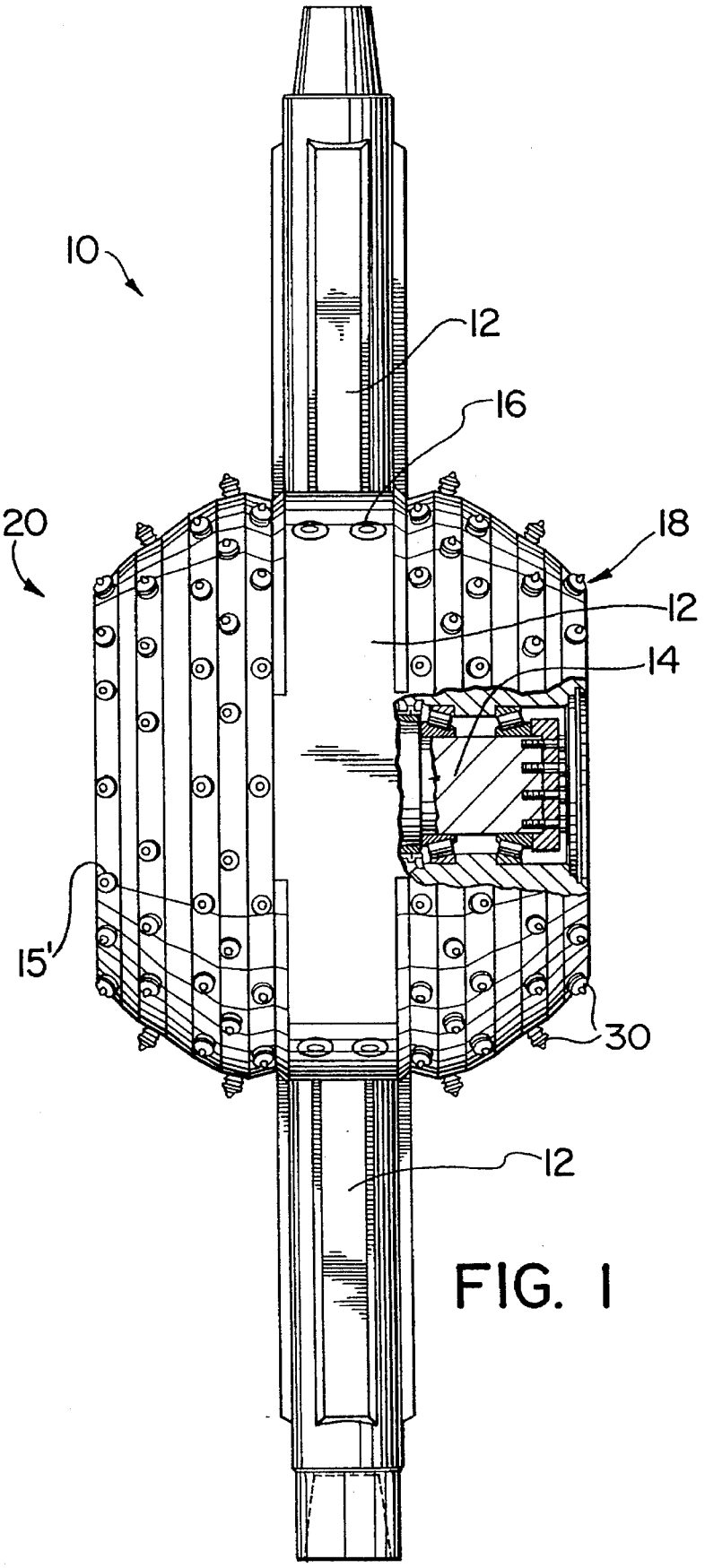
FIG. 1 is a front elevational view, partially cutaway, of an embodiment of the present invention.
Figure 2:
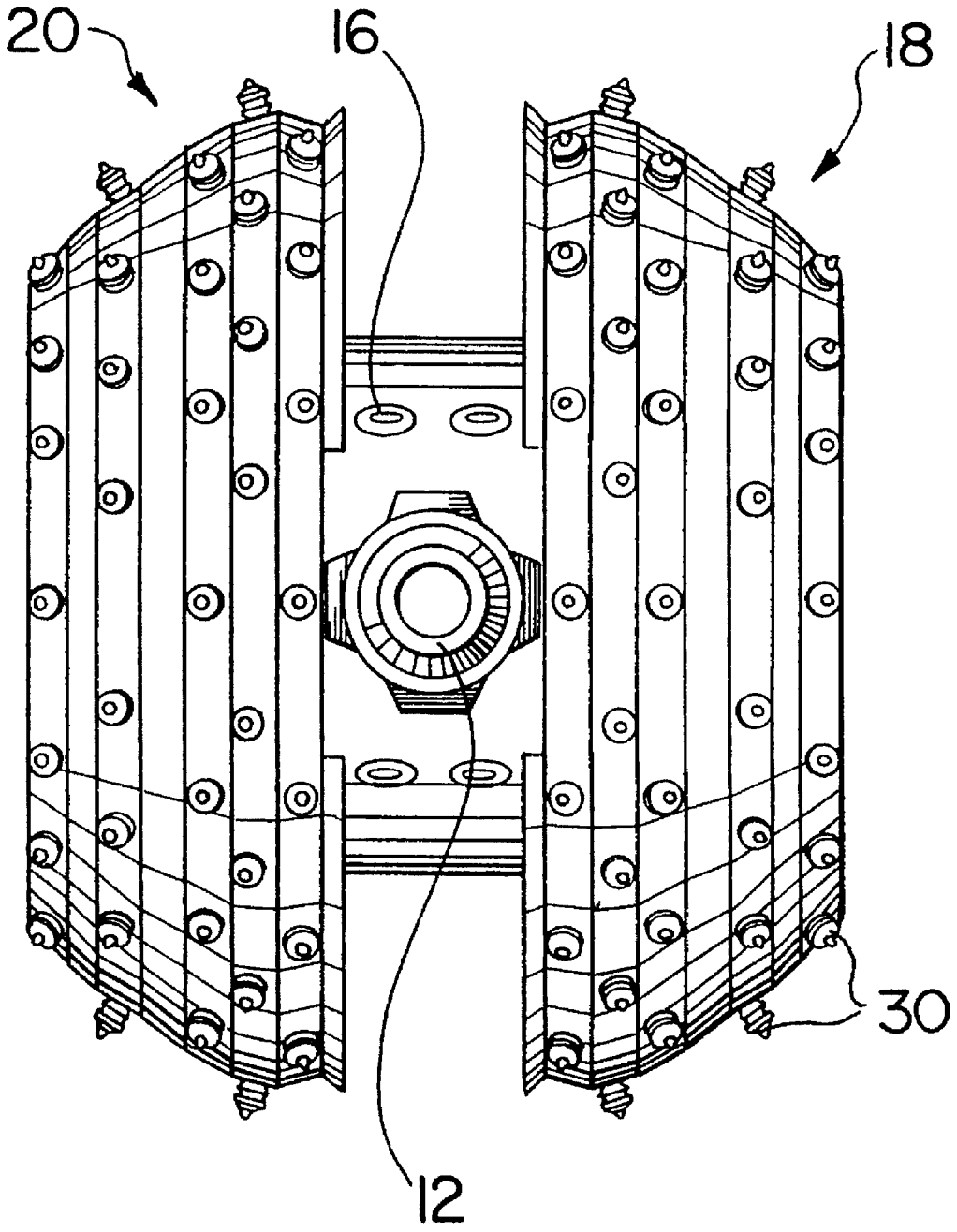
FIG. 2 is a top plan of FIG. 1.

In the drawings, reference numeral 10 denotes the overall reamer arrangement. The bit includes a double ended stem 12 from which project shafts 14 one of which is shown in the cut-away FIG. 1. Generally at the juncture of shaft 14 and stem 12 there is provided a plurality of openings 16 providing fluid access into channels (not shown) within bit 10 for cleaning or debris removal as is known in this art. The stem 12 is configured to permit connection with a drill rod (not shown) which effects rotation of the bit about a first axis coincident with the shafts. The cutting faces freely rotate about an axis orthogonal to the first axis.

In a first embodiment, the cutting faces denoted by numerals 18 and 20, comprise generally semi-spherical members rotatably each mounted to a shaft 14 the cutting faces 18 and 20 having a semi-circular outline. A plurality of spaced apart cutting bits, generally denoted by numeral 30 extend outwardly from each cutting face 18 and 20 discussed hereinafter.

Figure 3:
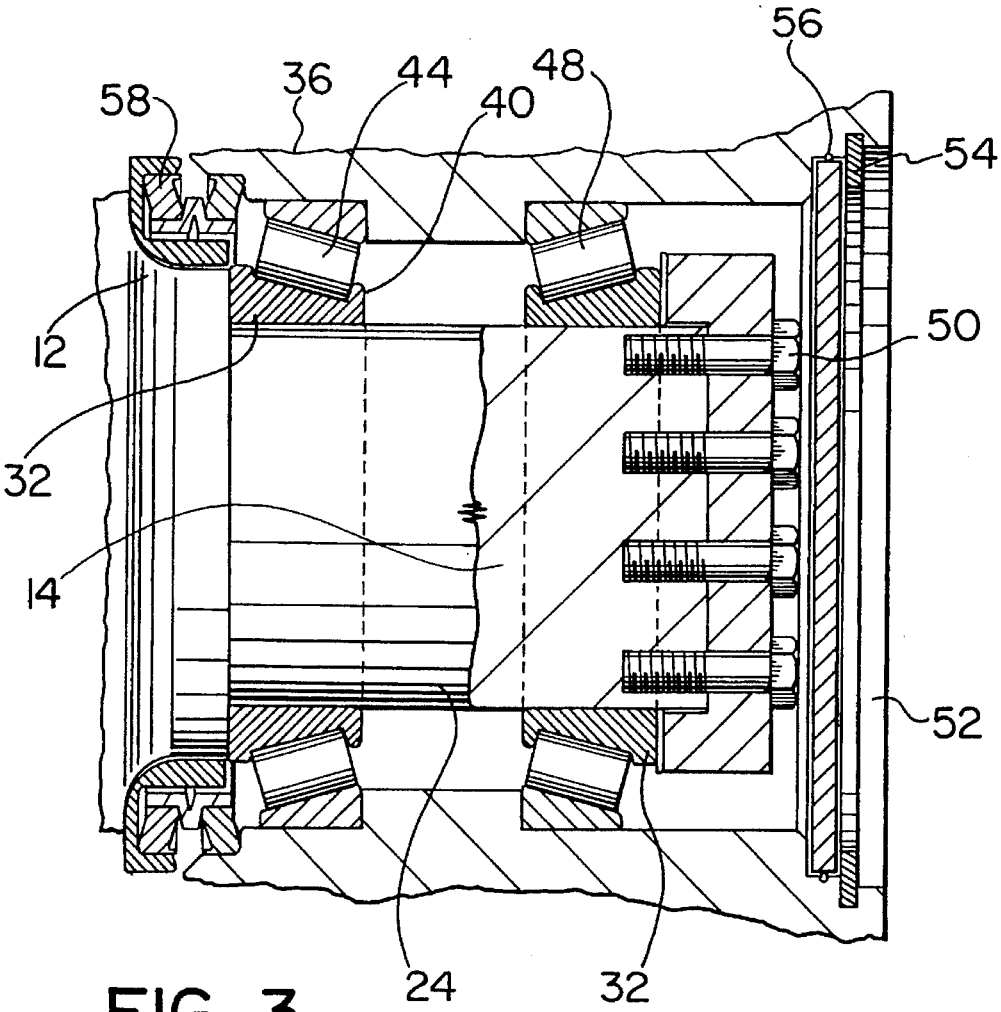
FIG. 3 is an enlarged view of the bearing arrangement shown in the cutaway portion of FIG. 1.

FIG. 3 illustrates an enlarged view of the bearing arrangement and the relationship between the cutting faces 18 and 20 and the shaft 14. Each shaft 14, only one being shown in FIG. 3, includes spaced annular bearing retainers 32 which each provide shoulders 36 and 40 for slidably retaining bearings 44 and 48.

Each cutting face 18 and 20 is retained to a respective shaft 14 by bolts 50 securing a face thereto. A cover plate 52 covers the bolt heads and is releasably retained to a lateral bearing element 24 or 28 by a snap ring fastener 54. Suitable dust or debris seals 56 and 58 are provided to prevent ingress of moisture, dust and other debris within the bearing. The bolts 50 may additionally be provided with openings (not shown) to receive a string clip. A preferred feature is that the bolt heads and cover plate 52 are recessed from the outer periphery of the faces 18 and 20 such that smooth semi-circular outline is not otherwise interrupted by an exterior mounting.

The size of the shafts 14 and the bearings 44,48 thereof are preferably the same size for a variety of differently sized cutting faces 18 and 20. This feature has the advantage of permitting quick interchange when a larger reamed opening is required.

Figure 5:
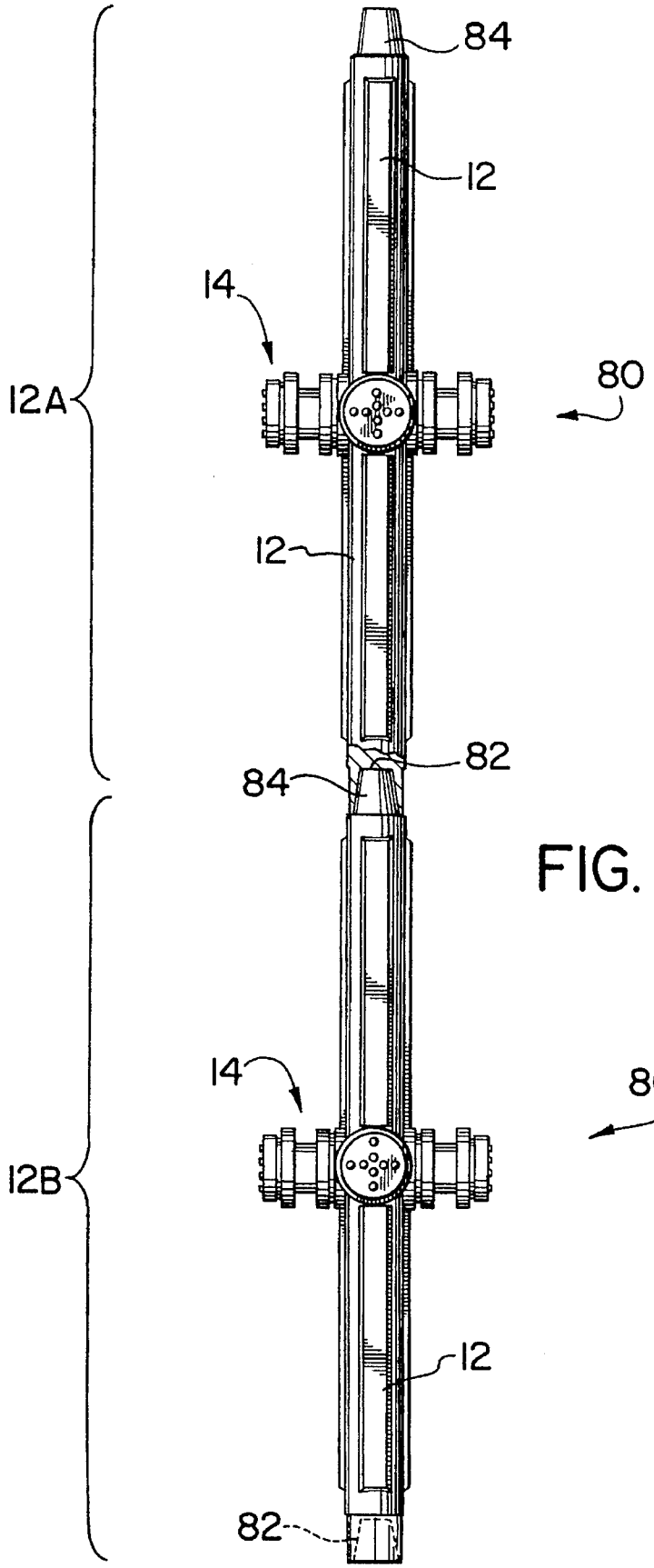
FIG. 5 is a side elevational view of the stem according to a further embodiment of the present invention.
Figure 6:
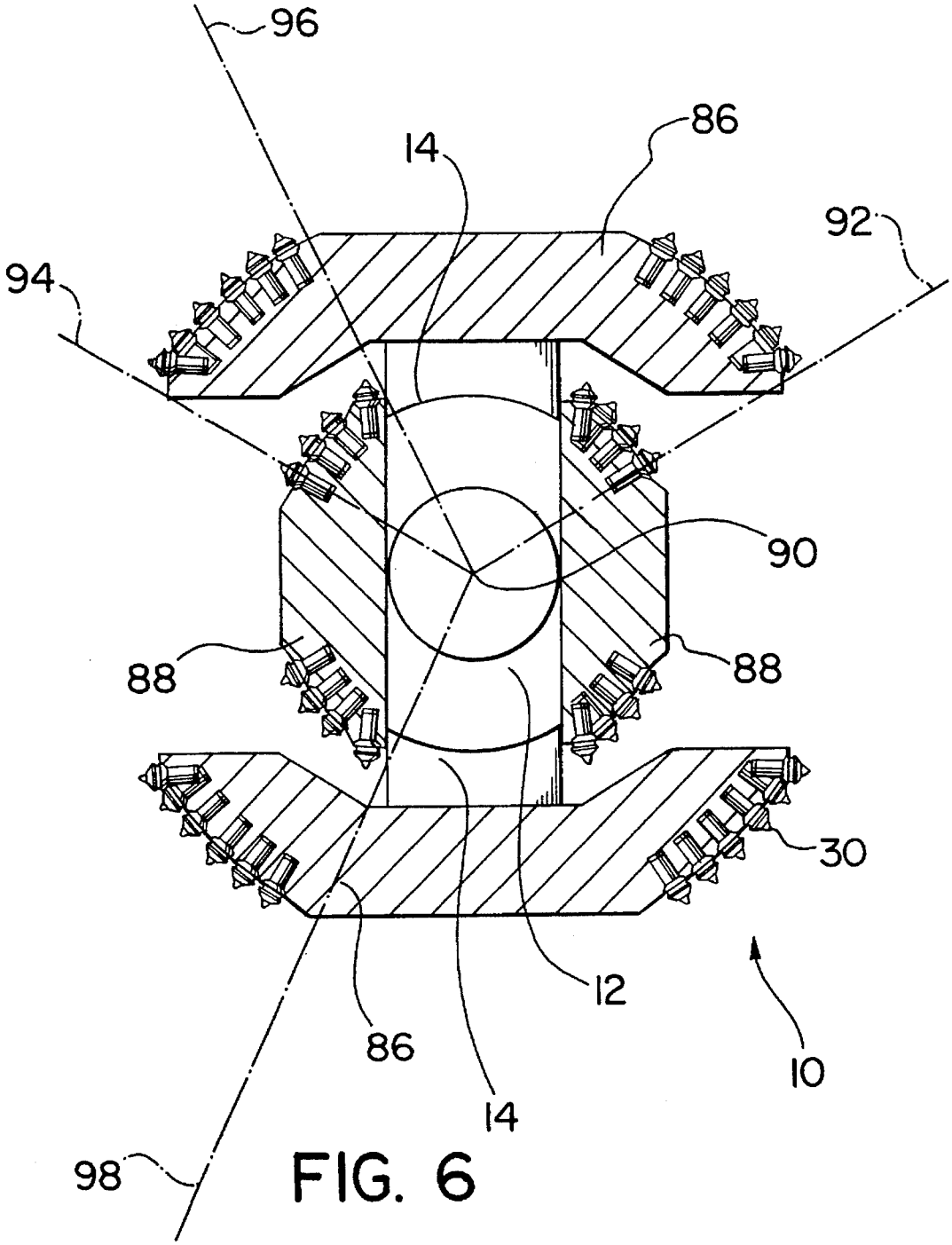
FIG. 6 is a top plan view of a stem having a multiple number of roller cutters.
Figure 7:
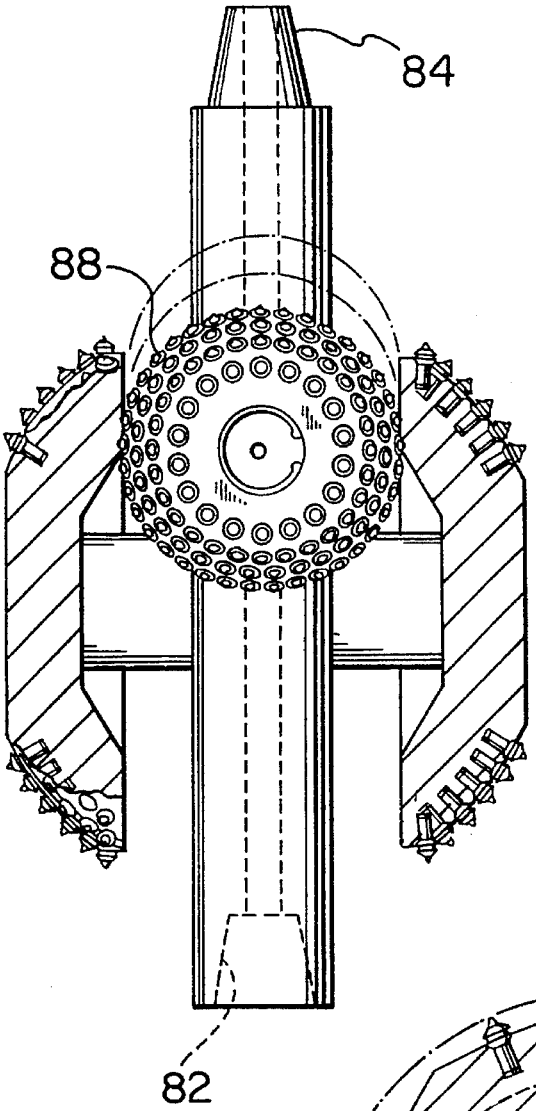
FIG. 7 is a side elevational view of FIG. 6.

Referring now to FIGS. 5 through 7, shown is an alternate embodiment of the present invention, in which FIG. 5 illustrates a multiple shaft stem. In the embodiment shown in FIG. 5, the stem 12 includes a plurality of levels 80 of shafts 14. In the example, the levels 80 of shafts 14 are in horizontal levels, the shafts within each level being in a coplanar relationship with one another. It will be readily appreciated by those skilled in the art that although a coplanar relationship in a level 80 is illustrated, the shafts may reside in parallel planes or in any other suitable form. This will generally depend on the application and the formation in which the bit is used.

Further, in the example illustrated, the shafts 14 between levels 80 are in a collinear relationship. This is one possible embodiment, it will be appreciated however, that the individual shafts may be in a non-collinear relationship between levels. Regarding the stem 12, the same includes a female end portion 82 for receiving a male portion 84 shown on, for example, stem 12. Where required, the end portions 82 and 84 may be of a similar form, i.e. a projection or a recess and further may be threaded.

As a further possible example, of the arrangement illustrated in FIG. 5, one may wish to "chain together" multiple stems 12 as is illustrated in FIG. 5 centrally in the stem 12 to provide two sections of the shaft 14. In this arrangement, the individual sections, denoted by numerals 12*a* and 12*b*, may include two or more shafts 14 in any level 80.

Regarding the number of levels of shafts and the number of shafts within each level, the angular relationship between the shafts can vary widely and the only limitation is that the spacing and angular disposition is sufficient so that individual roller cutters do not contact one another. In this regard, the shafts may be disposed relative to one another in an orthogonal relationship or any other smaller angular relationship, e.g. 60°, 45°, etc.

It has been found that a distinct benefit can be gained regarding the ability of the bit to operate for greater lengths of time and for significantly longer distances than that which was previously available in the prior art. Significant reduction in bit wear and increased drilling distance for the same bit can be realized when one observes the relationship of the center point of the stem. It has been found that true rolling can be achieved when the entire area, for example, the cross-sectional area of the roller cutter is within a sector of a circle formed by projecting divergent radii from the center point of the stem. In this manner, the divergent radii do not cross the cutter body. In the event that the entire cross-sectional area of the roller cutter cannot be embraced within the area of the sector, true rolling is not observed and as a natural consequence, the life span of the roller cutter is significantly reduced due to scuffing and premature bit wear. A concomitant difficulty is realized when a non-true rolling arrangement is employed since significant work demands increase and this can, of course, lead to the burn-out of the drive means, the jamming of the bit within a formation among a host of other problems all of which are extremely costly and involve significant down time. The true rolling relationship of the roller cutter relative to the center point of the stem will be discussed now in greater detail with reference to FIGS. 6 and 7.

Referring now to FIGS. 6 and 7, shown is an example of a reamer bit where the bit includes a pair of large exterior roller cutters 86, each roller cutter being rotatably mounted on a shaft 14 and positioned between the spaced apart roller cutters is a pair of further roller cutters 88 of a lesser diameter than roller cutters 86. Roller cutters 88 are similarly mounted on shafts (not shown).

FIG. 6 best illustrates the mounting relationship of the semi-circular (semi-spherical) three-dimensional space cutters 86 and 88 as they are arranged relative to stem 12. The center point of stem 12 is denoted by numeral 90 and four cutters 86 and 88. It is clear that the two radii 92 and 94 which are centered on the center of stem 12, radiate outwardly to form a sector. As is clearly evident from FIG. 6, the cross-sectional area of roller cutter 86 is completely within the area of the sector of the bit. This arrangement results in the true rolling of each of the rollers 86 and accordingly, no dragging or scuffing occurs on the bits 30 which, in turn, leads to longer life span of the bit and greater drilling distance possibility.

Regarding the upwardly directed cutters 88, a similar situation exists with respect to radii 96 and 98 extending from the center point of the stem 12.

In the embodiment illustrated in FIG. 7 cutters 88 are slightly elevated from the top surface of the exterior cutters 86. In a preferred arrangement, the smaller inwardly directed cutters 88 will at least partially extend beyond the cutting perimeter of cutters 86. This facilitates maximum cutting efficiency while, at the same time, alleviates the "uncut area" difficulty known in the mining art. By incorporating the inwardly directed cutters in the manner, the area which cannot be cut by exterior cutters 86, is cut by cutters 88. This feature is not essential, but it is only directed to enhancing the efficiency of a multiple roller bit. It will be appreciated that roller cutters 88 can be vertically elevated in any one of the positions outlined in chain line along the length of the stem 12 in FIG. 7.

Further, one end of stem 12 at 82 or 84 may include a tricone cutter or any other suitable bit known to be of use for drilling pilot holes or blind holes, known to those skilled in the art.

Figure 8:
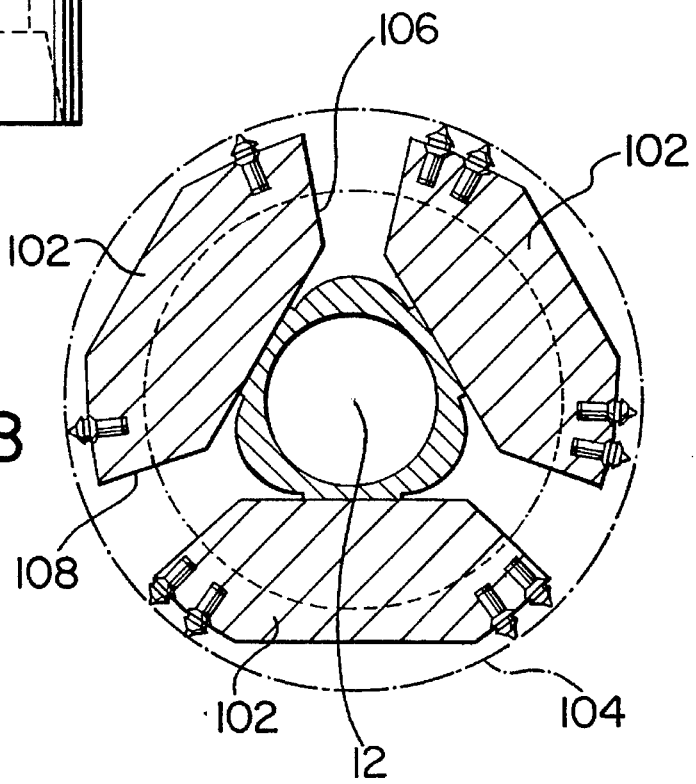
FIG. 8 is a top plan view of a further embodiment of the present invention.

FIG. 8 illustrates a top plan view of a further embodiment. In this embodiment, the bit 10 includes a triad of roller cutters, generally denoted by numeral 102. Similar to the previously discussed embodiments, this embodiment positions the roller cutters such that they are circumscribable within a sphere shown in chain line and denoted by numeral 104. Although indicated to be circumscribable within a sphere, the illustration is in plan view and accordingly, the roller cutters are inscribable within a circle.

As with the previously discussed embodiments, each of the cutters 102 is centered on the center point of stem 12 such that the cross-sectional area of each of the cutters 102 is completely contained within the radii of the sector, the radii being denoted by numerals 106 and 108.

It will be appreciated that the bits may include a series of different sized roller cutters or may comprise a series of similarly sized roller cutters. Further, although only two horizontal levels are illustrated in FIG. 5, it will be appreciated that the shaft can include any number of levels. In addition, where a plurality of levels are associated with the shaft, the roller cutters may be selected to provide a progressively larger spherical cutting surface in a triangular form known in the art as a tree structure.

Figure 4:
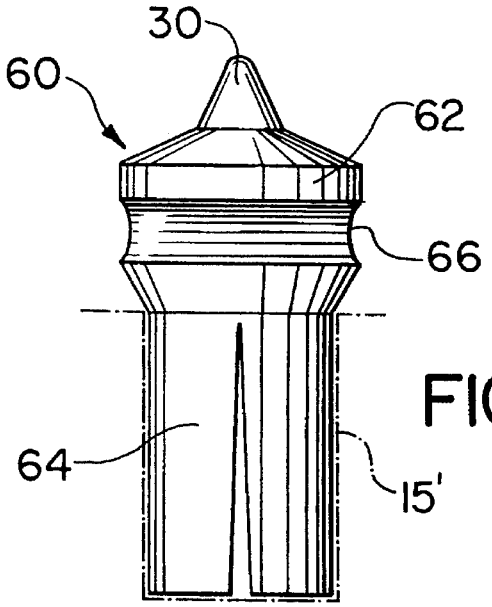
FIG. 4 is an enlarged sectional view of one embodiment for the holder arrangement.

Referring now to FIG. 4, there is illustrated an enlarged sectional view of the cutting bit and holder.

The cutters 30, each include a holder 60 for holding cutting bit 30. The holder, as shown in the example, provides a main body portion 62 having an integral cutting bit 30 projecting therefrom. A resilient member 64, e.g. a circular spring is provided on body 62 to facilitate frictional retention of holder 60 in opening 15. Cutting bit 30 may comprise a Kannenmetal pick, known to those skilled in the drilling art.

The cutting bit holders 60 may be removed and replaced when the cutting bit 30 is no longer useful. To this end, a peripheral groove 66 may be provided on body 62 to permit easy removal with a suitable tool (not shown).

As an attendant feature of the removable holder aspect of the invention, holders with differently sized bits or bits having a different metal content may be used with the same faces 18 and 20. Selection will depend on the type of formation to be reamed.

As an alternate embodiment, the semi-spherical cutting faces may be paired. In one example, the reaming bit may include a larger diameter pair of faces in spaced relation within which is disposed a pair having a smaller diameter.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A bit for reaming an opening in an earth formation, comprising:

at least one shaft for connection with drive means;

at least three stems on said shaft, each stem for movably mounting a semi-spherical roller cutter; and a plurality of semi-spherical roller cutters, each stem including a semi-spherical roller cutter, said roller cutters being arranged on said stems such that said semi-spherical roller cutters are circumscribable in a sphere.

2. The bit as set forth in claim 1, wherein said shafts are arranged in a horizontal level.

3. The bit as set forth in claim 2, wherein said shafts are coplanar.

4. The bit as set forth in claim 2, wherein bit includes a plurality of said horizontal levels.

5. The bit as set forth in claim 4, wherein said shafts in one level are collinear with shafts in a preceding level.

6. The bit as set forth in claim 4, wherein said shaft in one level are non-collinear with stems in a preceding level.

7. The bit as set forth in claim 1, wherein said bit is a reamer bit.

8. The bit as set forth in claim 1, wherein each said shafts includes a semi-spherical roller cutter having the same diameter.

9. The bit as set forth in claim 2, wherein said stems in a horizontal level include spherical roller cutters having the same diameter, the diameter of said roller cutters in succeeding levels having progressively larger diameters.

10. A stem having at least one end for use in drilling, said stem adapted for connection with drive means, said stem including at least three shafts in fluid communication with said stem, said shafts for releasably and rotatably mounting roller cutter means.

11. The stem as set forth in claim 10, wherein said shafts are arranged in a horizontal level.

12. The stem as set forth in claim 11, wherein said shafts in a horizontal level are disposed in a coplanar relationship.

13. The stem as set forth in claim 11, wherein said stem includes a plurality of horizontal levels.

14. The stem as set forth in claim 11, wherein said shafts in one level are collinear with a preceding level.

15. The stem as set forth in claim 11, wherein said shafts in one level are non-collinear with a preceding level.

16. The shaft as set forth in claim 10, wherein said stem includes opposed ends, one end projecting and including tread means and a second end having a threaded recess.

17. The shaft as set forth in claim 10, wherein said stem comprises at least two releasable engageable sections.

18. A reamer bit for reaming in earth formations, said reamer bit comprising:

stem means for connecting with a drive source;

a plurality of levels of shafts arranged on said stem means, said shafts having means for communicating with a fluid source;

a plurality of semi-spherical reamer cutters, each cutter being releasably and rotatably mounted to a shaft, said semi-spherical roller cutters being arranged on said shafts to provide a spherical reamer face.

19. The reamer bit as set forth in claim 18, wherein said semi-spherical roller cutters positioned on a level of shafts have the same diameter.

20. The reamer bit as set forth in claim 19, wherein one level of shafts includes roller cutters having a greater diameter than those on a preceding level of shafts.

21. The reamer bit as set forth in claim 18, wherein said plurality of levels of shafts comprise horizontal levels.

22. The reamer bit as set forth in claim 21, wherein said shafts in one level are in a non-collinear relationship with a preceding level.

* * * * *

UNITED STATES PATENT AND TRADEMARK OFFICE

CERTIFICATE OF CORRECTION

PATENT NO. : 5,485,888

DATED : Jan. 23, 1996

INVENTOR(S) : J. Richard England

It is certified that error appears in the above-indentified patent and that said Letters Patent is hereby corrected as shown below:

Title page,

Under the *Notice section, "Pat. No. 08/383,223" should be corrected to read -- Pat. No. 5,413,183 --.

Signed and Sealed this

Ninth Day of April, 1996

Bruce Lehman

*Attest:*

BRUCE LEHMAN

*Attesting Officer*

*Commissioner of Patents and Trademarks*